US007905578B2

(12) United States Patent
Nishi

(10) Patent No.: US 7,905,578 B2
(45) Date of Patent: Mar. 15, 2011

(54) LIQUID EJECTION HEAD AND LIQUID EJECTION DEVICE

(75) Inventor: Yasuo Nishi, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 10 days.

(21) Appl. No.: 12/450,049

(22) PCT Filed: Mar. 19, 2008

(86) PCT No.: PCT/JP2008/055083

§ 371 (c)(1),
(2), (4) Date: Sep. 9, 2009

(87) PCT Pub. No.: WO2008/117716

PCT Pub. Date: Oct. 2, 2008

(65) Prior Publication Data

US 2010/0020131 A1 Jan. 28, 2010

(30) Foreign Application Priority Data

Mar. 28, 2007 (JP) ..... 2007-085216

(51) Int. Cl.
*B41J 2/045* (2006.01)
*B41J 2/14* (2006.01)
*B41J 2/06* (2006.01)

(52) U.S. Cl. ..... 347/68; 347/47; 347/55

(58) Field of Classification Search ..... 347/68, 347/69–72, 40, 47, 54–56, 112; 400/124.14, 400/124.16; 310/311, 324, 327, 358, 365
See application file for complete search history.

(56) References Cited

U.S. PATENT DOCUMENTS

| | | | | |
|---|---|---|---|---|
| 6,685,301 | B2 | 2/2004 | Eida et al. | |
| 6,854,830 | B2 | 2/2005 | Gue et al. | |
| 2005/0024431 | A1* | 2/2005 | Miura et al. | 347/47 |
| 2005/0195245 | A1 | 9/2005 | Yamada et al. | |
| 2006/0017782 | A1 | 1/2006 | Nishi et al. | |
| 2008/0018678 | A1* | 1/2008 | Shimura | 347/68 |
| 2008/0211871 | A1* | 9/2008 | Sakurai et al. | 347/47 |

FOREIGN PATENT DOCUMENTS

| | | | |
|---|---|---|---|
| JP | 08-085212 | A | 4/1996 |
| JP | 2000-229423 | A | 8/2000 |
| JP | 2002-355977 | A | 12/2002 |
| JP | 2005-249436 | A | 9/2005 |

* cited by examiner

*Primary Examiner* — K. Feggins
(74) *Attorney, Agent, or Firm* — Holtz, Holtz, Goodman & Chick, P.C.

(57) ABSTRACT

A liquid ejection head which can fly a minute high viscosity droplet with high precision by a low drive voltage in electric field assist system which exhibiting excellent maintainability such as cleaning. The liquid ejection head (2) comprises a nozzle plate (4) provided with a nozzle (5) having a liquid supply opening (9) for supplying a liquid (L), an ejection opening (11) for ejecting the liquid (L), and a liquid supply passage for supplying the liquid (L) from liquid supply opening (9) to the liquid ejection opening (11), a cavity (20) for storing the liquid (L), a pressure generating means for generating pressure in the cavity (20), and an electrostatic voltage generating means for generating an electrostatic attraction between the liquid (L) and a substrate. The liquid supply opening side of the nozzle (5) is formed of a silicon layer (41), the ejection opening side of the nozzle is formed of at least one resin layer (42) composed of thermosetting or photosensitive fluorine polymer having a volume resistivity of $10^{15}\Omega$ or above and a dielectric constant of 3 or less, and the diameter of the nozzle (5) on the liquid supply opening side is larger than that of the nozzle on the liquid ejection side.

8 Claims, 9 Drawing Sheets

LIQUID EJECTION HEAD AND LIQUID EJECTION DEVICE

This application is the United States national phase application of International Application PCT/JP2008/055083 filed Mar. 19, 2008.

TECHNICAL FIELD

The present invention relates to a liquid ejection head and to a liquid ejection device, and in particular, to a liquid ejection head and to a liquid ejection device which can cause a minute high viscosity droplet to eject with the low drive voltage.

BACKGROUND TECHNOLOGY

With advances of the trend for high-definition of image quality in ink jet and with expansion of a range of application in industrial uses in recent years, demands for minute pattern formation and for ejection of high viscosity ink have been strengthened increasingly, and there have been advanced the development of the liquid ejection device for solving the aforesaid subjects and of the method for its manufacturing (for example, see Patent Documents 1-5 listed below).

Among them, as a technology to eject not only low viscosity droplets but also high viscosity droplets from a miniaturized nozzle to meet the aforesaid demands, there is known a droplet ejection technology of the so-called electrostatic suction method wherein a liquid in a nozzle is charged, and liquid ejection is carried out by electrostatic attraction force that is received from an electric field that is formed between a nozzle and various types of base member serving as objects to receive impact of droplets.

Further, there is advancing development of a droplet ejection device employing the so-called electric field assist system which is a combination of this droplet ejection technology and a technology to eject droplets by utilizing pressure caused by deformation of piezoelectric element and by generation of bubbles in a liquid.

This electric field assist system is a method wherein a meniscus of a liquid is protruded at a liquid ejection opening of the nozzle by the use of a meniscus forming device and an electrostatic attraction force, to enhance the electrostatic attraction force for the meniscus and to overcome the liquid surface tension so that the meniscus may be made to be droplets to be ejected.

In the electric field assist system, a droplet is formed from a nozzle by the resultant force of the pressure and the electrostatic attraction force as stated above, and the droplet thus formed is caused by electrostatic attraction force to fly to base member, therefore, the impact ability for a minute droplet is more improved than those of the conventional piezoelectric method and a thermal method.

Further, in the conventional piezoelectric method or the thermal method, the total energies for forming a meniscus and for causing it to fly to impact against a base member need to be covered by pressure caused by deformation of the piezoelectric element and the like, while, energies needed for generating pressure required in the electric field assist system are only energies for forming a meniscus and for forming a droplet. Therefore, a drive voltage for a pressure generating device composed of a piezoelectric actuator such as a piezoelectric element can be lower than that for the conventional method, which is an advantage.

Patent Document 1: Unexamined Japanese Patent Application Publication No. 2005-249436

Patent Document 2: Unexamined Japanese Patent Application Publication No. H08-85212

Patent Document 3: Unexamined Japanese Patent Application Publication No. 2004-503377

Patent Document 4: Unexamined Japanese Patent Application Publication No. 2000-229423

Patent Document 5: Unexamined Japanese Patent Application Publication No. 2002-355977

DISCLOSURE OF THE INVENTION

Problems to be Solved by the Invention

However, when making a nozzle diameter to be small for ejecting a minute droplet and when trying to eject high viscosity droplet, viscosity resistance in the nozzle is enhanced. Therefore, even in the electric field assist system, it is necessary to raise drive voltage for a piezoelectric element to a certain extent for causing a meniscus to protrude and thereby to form a droplet. Therefore, when applying to a multi-head that has many nozzles for that equivalent, electricity consumption is increased, which being a problem.

The invention has been achieved in view of the aforesaid points, and its objective is to provide a liquid ejection head in which a minute high viscosity droplet can be caused by low drive voltage to fly highly accurately in the electric field assist system, and maintenance including cleaning is easy and to provide a liquid ejection device.

Means for Solving the Problems

For attaining the aforesaid objectives, a liquid ejection head described in claim 1 includes: a nozzle plate equipped with a nozzle having a liquid supply inlet through which a liquid is supplied, a liquid ejection opening through which the liquid supplied from the liquid supply inlet is ejected, and a liquid supply path through which a liquid is supplied from the liquid supply inlet to the liquid ejection opening; a cavity which is communicated with the liquid supply inlet, and stores the liquid to be ejected from the liquid ejection opening; a pressure generating device which generates a pressure to the liquid in the cavity by changing a volume of the cavity; and an electrostatic voltage generating device which applies electrostatic voltage to generate an electrostatic attraction force between a base member and the liquid in the nozzle and the cavity, wherein a liquid supply inlet side of the nozzle plate is formed of a silicon layer, and a liquid ejection opening side of the nozzle plate is formed of at least a resin layer comprising thermosetting or photosensitive fluorine polymer having a volume resistivity of $10^{15}$ Ωm or more and relative permittivity of 3 or less, and wherein a nozzle diameter on the liquid supply inlet side of the nozzle is greater than a nozzle diameter on the liquid ejection opening side of the nozzle.

The invention described in claim 2 is the liquid ejection head described in claim 1 characterized in that the resin layer has absorptivity of 0.3% or less of the liquid.

The invention described in claim 3 is the liquid ejection head described in claim 1 or claim 2 characterized in that a thickness of the resin layer is 5 μm or more.

The invention described in claim 4 is the liquid ejection head described in any one of claims 1-3, characterized in that a glass transition temperature of thermosetting or photosensitive fluorine polymer which forms the aforesaid resin layer is 350° C. or more.

The invention described in claim 5 is the liquid ejection head described in any one of claims 2-4, characterized in that the resin layer is composed of two or more layers sandwiching an intermediate layer made of Si or SiH.

The invention described in claim 6 is the liquid ejection head described in any one of the claims 1-5, characterized in that a liquid-repellent layer is formed on a surface of the resin layer of the nozzle plate on the liquid ejection opening side through an intermediate layer made of $SiO_2$.

The invention described in claim 7 is the liquid ejection head described in claim 6, characterized in that a thickness of an intermediate layer made of the aforesaid $SiO_2$ is 1 μm or more.

The liquid ejection device described in claim 8 is provided with the liquid ejection head described in any one of claims 1-7, and an opposing electrode that opposes the liquid ejection head, and characterized in that the aforesaid liquid is ejected by the aforesaid electrostatic attraction force generated between the liquid ejection head and the opposing electrode and by pressure generated in the aforesaid nozzle.

Effect of the Invention

In the invention described in claim 1, smoothness and stiffness are obtained by silicon on the liquid supply side of the nozzle plate, thereby, it becomes possible to concentrate an electric field on a nozzle tip portion of thermosetting or photosensitive fluorine polymer on the nozzle ejection outlet side, thus, drive voltage necessary for ejecting a liquid can be lowered because strong electrostatic attraction force can be generated stably for a long time.

Further, a meniscus protrudes greatly under the lower electrostatic voltage, whereby, a voltage value of electrostatic voltage to be impressed can be lowered by an electrostatic voltage generating device.

In the invention described in claim 2, since the nozzle plate is formed with thermosetting or photosensitive polymer whose absorptivity for a liquid is 0.3% or less, strong electrostatic attraction force can be generated stably for a long time, without being affected by solid state properties of a liquid, which makes it possible to lower drive voltage that is needed to eject a liquid.

In the invention described in claim 3, a thickness of thermosetting or photosensitive fluorine polymer is made to be 5 μm or more, therefore, electric field concentration on the circumference of a nozzle is enhanced, and more stronger electrostatic attraction force can be generated, thus, drive voltage needed for forming a meniscus and for forming a droplet can further be lowered.

In the invention described in claim 4, a glass transition temperature of thermosetting or photosensitive fluorine polymer is made to be 350° C. or more, which makes it possible to conduct anodic bonding that is accompanied by overheat process that can improve clogging for fine nozzle greatly in the case of assembly joining.

In the invention described in claim 5, owing to the construction for thermosetting or photosensitive fluorine polymer that is composed of two or more layers wherein Si or SiH is for a intermediate layer, when a thickness of the total layers made of thermosetting or of photosensitive fluorine polymer is increased, it becomes possible to increase easily to the desired thickness, resulting in further higher concentration of an electric field to the circumference of the nozzle, thus, stronger electrostatic attraction force is generated, and the drive voltage that is needed for formation of a meniscus and of a droplet can further be lowered accordingly.

In the invention described in claim 6, a liquid-repellent layer is formed through an intermediate layer made of $SiO_2$ on a surface where the liquid ejection opening of the nozzle plate is opened, which makes it possible to strengthen adhesiveness of the liquid-repellent layer.

In the invention described in claim 7, a thickness of an intermediate layer made of $SiO_2$ is made to be 1 μm or more, which causes stiffness of a nozzle made of thermosetting or photosensitive fluorine polymer formed on its liquid ejection opening side to be improved, then, causes ejection characteristics to be improved and causes stiffness of a base plate of the liquid-repellent layer to be improved, which makes it possible to improve abrasion resistance in the case of cleaning operations.

In the invention described in claim 8, a droplet ejected from the nozzle is caused by an effect of electrostatic attraction force from an electric field to try to make an impact on the closer portion on the base member, therefore, an angle for the base member in the case of making an impact can be stabilized, which makes it possible to impact a droplet accurately on a prescribed impact position. It is further possible to lower a voltage value of electrostatic voltage impressed by an electrostatic voltage generating device, and thereby, to cause effects of the inventions described in aforesaid claims to be exhibited effectively, when a meniscus protrudes greatly with electrostatic low voltage in the same way as in the inventions described in the aforesaid claims.

FIGS. **9*a*-9*d*** are cross-sectional views showing a part of a forming process for a liquid ejection head relating to the present embodiment.

FIGS. **10*a*-10*c*** are cross-sectional views showing a part of a forming process for a liquid ejection head relating to the present embodiment.

Figure 11:
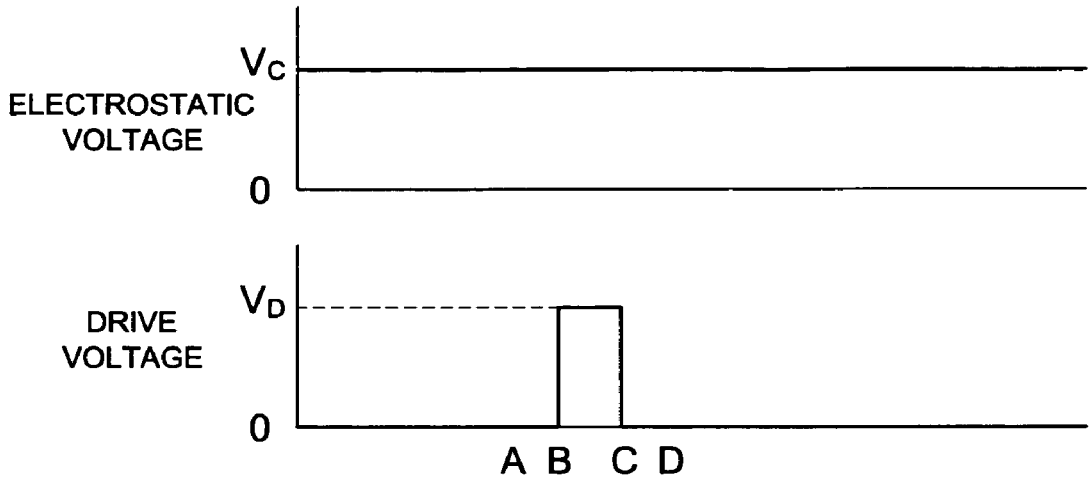
Figure 11:
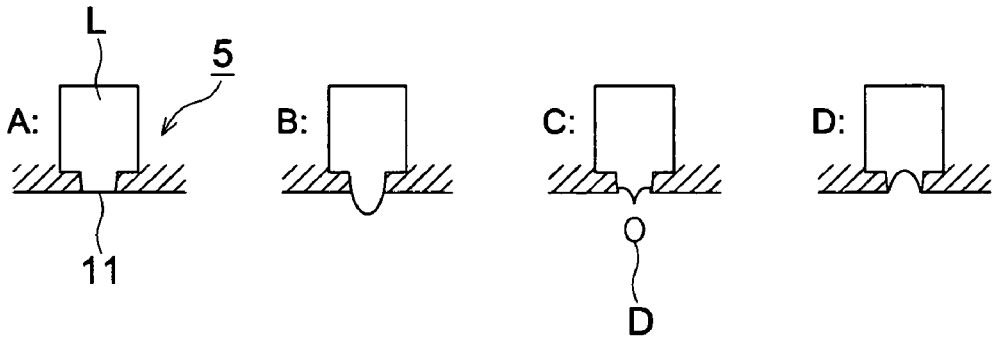

FIG. 11 is a schematic view illustrating drive control for a liquid ejection head relating to the present embodiment.

FIGS. **12*a*-12*c*** are diagrams showing a variety of drive voltage to be impressed on a piezoelectric element.

EXPLANATION OF SYMBOLS

1. Liquid ejection device
2. Liquid ejection head
3. Opposing electrode

4. Nozzle plate
41. Silicon layer
42. Resin layer
43. Intermediate layer
5. Nozzle
6. Liquid ejection surface
61. liquid-repellent layer
62. Intermediate layer
9. Liquid-supply inlet
10. Large diameter section
11. Liquid ejection opening
12. Small diameter section
14. Electrode for charging
15. Inner circumferential surface
16. Electrostatic voltage power supply (Electrostatic voltage generating device)
19. Body layer
20. Cavity
21. Flexible layer
22. Piezoelectric element (Pressure generating device)
23. Drive voltage power supply
24. Operation control device
25. CPU
26. ROM
29. RAM
30. Silicon base plate
31. Thermosetting fluorine polymer layer
32. SiH film
33. Oxide film
K. Base member
L. Liquid

DESCRIPTION OF THE PREFERRED EMBODIMENT

Figure 1:
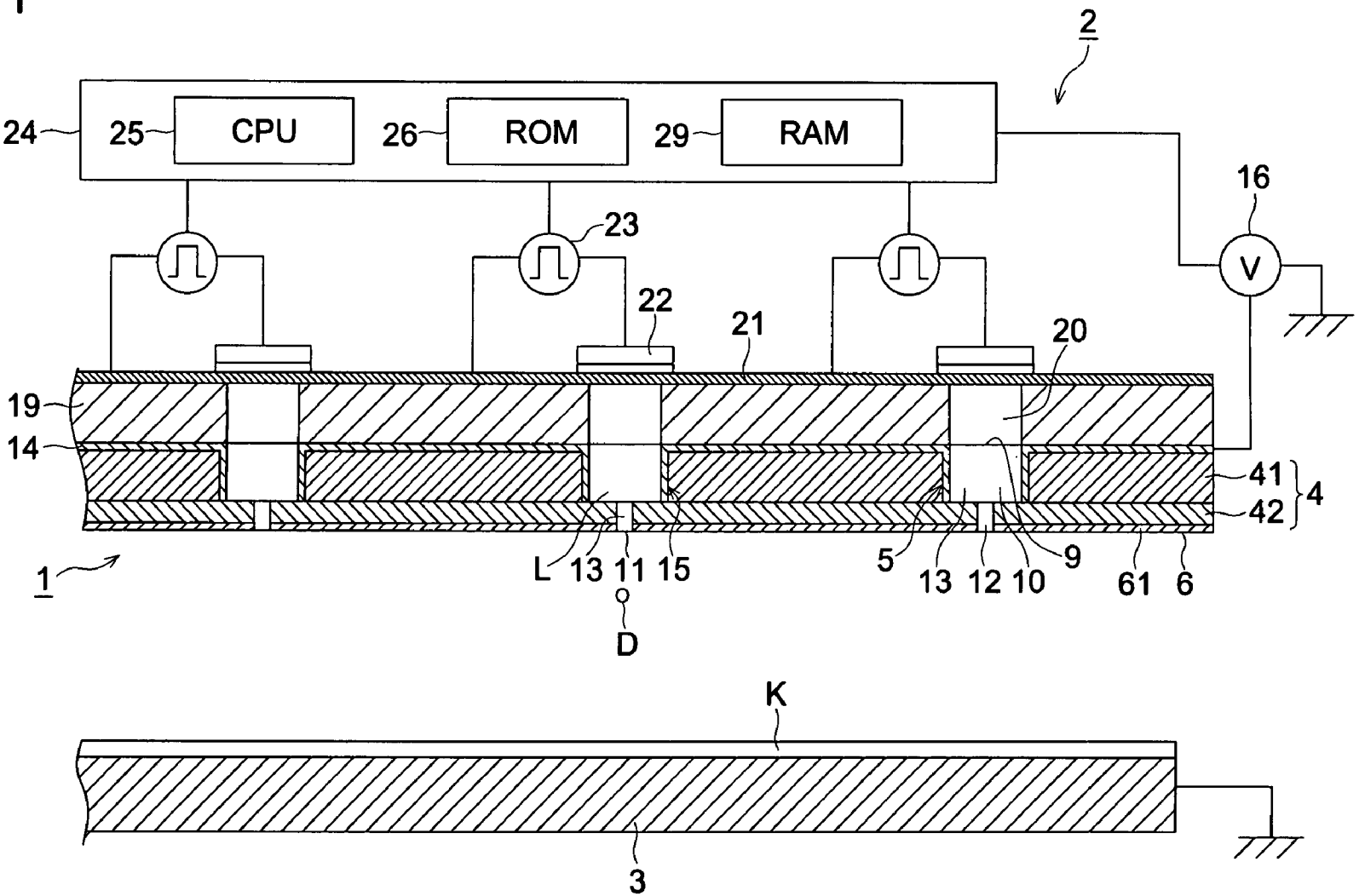
FIG. 1 is a sectional schematic view showing an overall structure of a liquid ejection device relating to the present embodiment.

An embodiment of the liquid ejection device relating to the present invention will be explained as follows, referring to the drawings. FIG. 1 is a sectional schematic view showing an overall structure of liquid ejection device 1 relating to the present embodiment. Incidentally, liquid ejection head 2 of the invention can be applied to various types of liquid ejection devices including those of the so-called serial system or of the line system.

Liquid ejection device 1 of the present embodiment is equipped with liquid ejection head 2 on which nozzle 5 that ejects droplet D of liquid L that can be charged such as ink is formed and is described later and with opposing electrode 3 that has an opposing surface facing the nozzle 5 of the liquid ejection head 2, and supports base member K which receives impact of droplet D with its opposing surface.

On the side of the liquid ejection head 2 facing the opposing electrode 3, there is equipped nozzle plate 4 on which a plurality of nozzles 5 are formed.

Figure 2:
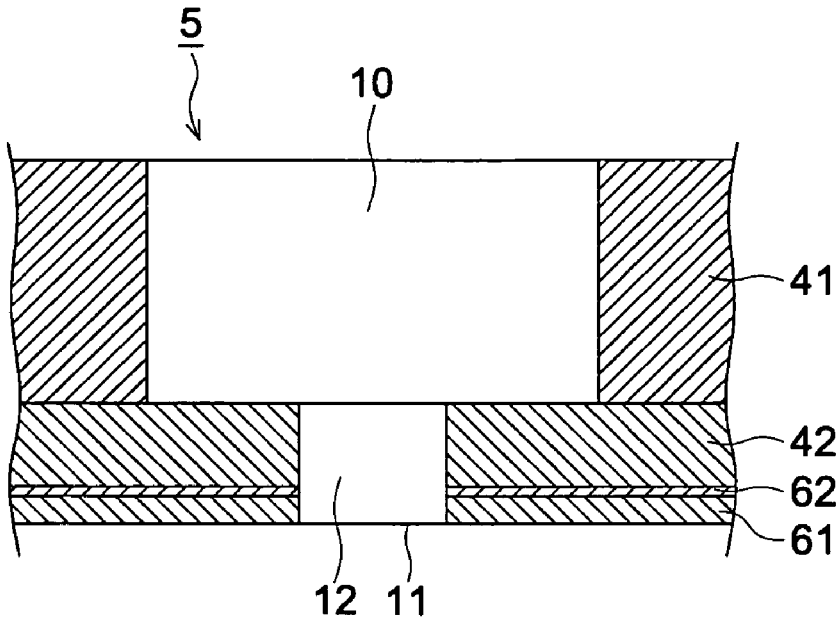
FIG. 2 is an enlarged sectional view showing structures of a nozzle and a nozzle plate.

Each nozzle 5 is formed by perforating a hole on nozzle plate 4 as shown in FIGS. 1 and 2, and it is of a two-step construction including large diameter section (liquid-supply inlet side) 10 that is communicated with liquid-supply inlet 9 through which liquid L is supplied from cavity 20 described later and small diameter section (liquid ejection opening side) 12 that is communicated with a part of the bottom surface of the large diameter section 10, and each nozzle is constructed so that a nozzle diameter of the large diameter section 10 is larger than that of the small diameter section 12.

The nozzle diameter in this case means a diameter of an opening when the opening is circular. Meanwhile, a shape of the opening is not limited to a circular shape, and it may also be an elliptical shape or a polygonal shape, instead of a circular shape. Incidentally, when a shape is not circular, the shape is replaced with a circle whose area is the same as that of the other shape, and a diameter of that circle is made to be the nozzle diameter.

The bottom surface of small diameter section 12 is communicated with liquid ejection opening 11 formed on liquid ejection surface 6, so that droplet D can be ejected from the liquid ejection opening 11 to opposing electrode 3.

Nozzle plate 4 is composed of silicon layer 41 and of resin layer 42 that is made of thermosetting fluorine polymer, to be of a laminated structure.

Thermosetting fluorine polymer with which the resin layer 42 is formed has solid state property values including volume resistivity of $10^{15}$ Ωm or more, relative permittivity of 3 or less and glass transition temperature of 350° C. or more, and for example, ASAHI Low-K polymer (made by Asahi Glass Co.) can be used.

By constructing the nozzle plate 4 in this manner, more smoothness and stiffness are obtained in silicon layer 41 of nozzle 5, and an electric field can be concentrated on the tip portion of the nozzle of resin layer 42.

Further, a water absorptivity of resin layer 42 is made to be 0.3 or less. Owing to this, strong electrostatic attraction force can be generated stably for a long time, without being affected by properties of liquid L.

Further, the resin layer 42 is formed to be 5 μm or more in terms of its thickness, so that concentration of an electric field on the circumference of nozzle 5 may be enhanced, and stronger electrostatic attraction force can be generated.

Further, small diameter section 12 of each nozzle 5 is formed by perforating resin layer 42 of nozzle plate 4.

On the liquid ejection surface 6 of nozzle plate 4 of liquid ejection head 2, liquid-repellent layer 61 for controlling oozing out of liquid L from liquid ejection opening 11 is provided on the entire surface of the liquid ejection surface 6 excluding the liquid ejection opening 11. For example, when liquid L is aqueous, it is preferable to use water-repellent materials for the liquid-repellent layer 61, and when liquid L is oily, it is preferable to use oil-repellent materials for the liquid-repellent layer 61. In general, fluorine resins such as FEP (ethylene tetrafluoride.propylene hexafluoride), PTFE (polytetrafluoroethylene), fluorine-containing siloxane, fluoro alkyl silane and amorphous perfluoro resins are commonly used, and they are used to form a film on liquid ejection surface 6 through a method of coating or of vapor deposition.

Further, there is provided intermediate layer 62 made of $SiO_2$ on a critical plane between liquid-repellent layer 61 and the aforesaid resin layer 42, for improving adhesiveness of the liquid-repellent layer 61. A thickness of the intermediate layer 62 is set to 1 μm or more, and by constructing in this manner, stiffness on a nozzle tip portion of resin layer 42 is improved, thus, projection characteristics are improved, and stiffness on the foundation base plate of liquid-repelling layer 61 is improved.

Liquid ejection head 2 is constructed to be a head on which the nozzle 5 does not protrude from liquid ejection surface 6 that faces the opposing electrode 3 of nozzle plate 4, or to be a head having a flat liquid ejection surface on which an amount of protrusion of the nozzle 5 is only about 30 μm.

Electrode for charging 14 that is made of conductive raw material such as NiP, for example, and charges liquid L in nozzle 5 is provided to be in a layer form on the surface opposite to liquid ejection surface 6 of nozzle plate 4. In the present embodiment, the electrode for charging 14 is provided to be extended to inner circumferential surface 15 of large diameter section 10 of nozzle 5 so that the electrode may come in contact with liquid L in nozzle 5.

Further, the electrode for charging 14 is connected with electrostatic voltage power supply 16 serving as an electrostatic voltage generating device that applies electrostatic voltage that generates electrostatic attraction force, and thereby, a single electrode for charging 14 is in contact with liquids L in all nozzles 5. Therefore, when electrostatic voltage is impressed on electrode for charging 14 from the electrostatic voltage power supply 16, liquids L in all nozzles 5 are charged electrically simultaneously, and electrostatic attraction force is generated between liquid ejection head 2 and opposing electrode 3, especially between liquid L and base member K.

Body layer 19 is provided behind electrode for charging 14. On the portion facing the opening end of large diameter section 10 of each nozzle 5 of the body layer 19, there is formed a space that is almost in a shape of a cylinder having the similar inside diameter that is mostly the same as the opening end, and each space is made to be cavity 20 for storing temporarily liquid L to be ejected.

Flexible layer 21 composed of a flexible metallic thin plate or silicon is provided behind the body layer 19, and liquid ejection head 2 is separated from the outside by the flexible layer 21.

Incidentally, on the boundary section adjacent to the flexible layer 21 of body layer 19, there are formed unillustrated channels through which the liquid L is supplied to cavity 20. Specifically, there are provided common channels obtained by etching a silicon plate representing body layer 19 and a channel that connects the common channels with the cavity 20. To the common channels, there is communicated an unillustrated a supply tube that supplies liquid L from an external unillustrated liquid tank, so that an unillustrated supply pump provided on the supply tube, or a difference pressure by position of arrangement of a liquid tank may give prescribed pressure to liquids L in channels, cavity 20 and nozzle 5.

On the portion corresponding to each cavity 20 on an external surface of flexible layer 21, there is provided piezoelectric element 22 representing a piezoelectric actuator serving as each pressure generating device, and drive voltage power supply 23 for deforming an element by impressing drive voltage on the element is connected to the piezoelectric element 22. The piezoelectric element 22 is deformed by impression of drive voltage from drive voltage power supply 23 to cause liquid L in the nozzle to generate pressure and thereby to form a meniscus of liquid L on liquid ejection opening 11 of nozzle 5. Incidentally, with respect to a pressure generating device, those of an electrostatic actuator type and those of a thermal system, for example, can also be employed, in addition to those of a piezoelectric element actuator type as in the present embodiment.

The aforesaid electrostatic voltage power supplies 16 which impress electrostatic voltage respectively on drive voltage power supply 23 and on electrode for charging 14 are connected respectively to an operation control device 24 to be controlled respectively by the operation control device 24.

In the present embodiment, the operation control device 24 is composed of a computer that is constructed through connection by BUS wherein CPU25, ROM26 and RAM29 are not illustrated, and CPU25 drives electrostatic voltage power supply 16 and drive voltage power supply 23 based on power supply control program stored in ROM26, to eject liquid L from Liquid ejection opening 11 of nozzle 5.

Under liquid ejection head 2, opposing electrode 3 that is in a flat shape and supports base plate K is arranged to be in parallel with liquid ejection surface 6 of liquid ejection head 2, to be apart by a prescribed distance from the liquid ejection head. A distance between the opposing electrode 3 and the liquid ejection head 2 is established properly within a range of about 0.1-3.0 mm.

In the present embodiment, the opposing electrode 3 is grounded and is kept to be at grounding potential constantly. Therefore, when electrostatic voltage is impressed on electrode for charging 14 from the aforesaid electrostatic voltage power supply 16, an electric field is generated between liquid L on liquid ejection opening 11 of nozzle 5 and an opposing surface that faces liquid ejection head 2 of the opposing electrode 3. Further, when charged droplet D impacts against base member K, the opposing electrode 3 causes its charges to leave through grounding.

Meanwhile, on the opposing electrode 3 or on the liquid ejection head 2, there is provided an unillustrated positioning device that moves the liquid ejection head 2 and base member K relatively for positioning, and owing to this, droplet D ejected from each nozzle 5 of the liquid ejection head 2 can impact to any position on a surface of base member.

With respect to liquid L that is ejected by liquid ejection device 1, there are given, for example, water, $COCl_2$, HBr, $HNO_3$, $H_3PO_4$, $H_2SO_4$, $SOCl_2$, $SO_2Cl_2$ and $FSO_3H$, as an inorganic liquid.

Further, as an organic liquid, there are given alcoholic liquors such as methanol, n-propanol, isopropanol, n-butanol, 2-methyl-1-propanol, tert-butanol, 4-methyl-2-pentanol, benzyl alcohol, α-terpineol, ethylene glycol, glycerin, diethylene glycol and triethylene glycol; phenolic acids such as phenol, o-cresol, m-cresol and p-cresol; etheric kinds such as dioxane, furfural, ethylene glycol dimethyl ether, methyl cellosolve, ethyl cellosolve, butyl cellosolve, ethyl carbitol, butyl carbitol, butyl carbitol acetatel and epichlorohydrin; ketons such as acetone, methyl ethyl ketone, 2-methyl-4-pentanone and acetophenon; fatty acids such as pseudo-acid, acetic acid, dichloroacetic acid and trichlolo acetic acid; ester varieties such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzoate, diethylmalonate, dimethyl phthalate, diethyl phthalate, diethyl carbonate, ethylene carbonate, propylene carbonate, cellosolve acetate, butylcarbitol acetate, ethyl acetoacetate, cyano-complex methyl and cyano-complex ethyl; nitrogen-containing compounds such as nitromethane, nitrobenzene, acetonitrile, propionitrile, succinonitrile, vareronitrile, benzonitrile, ethylamine, diethylamine, ethylenediamine, aniline, N-methyl aniline, N,N-dimethyl aniline, o-toluidine, p-toluidine, piperidine, pyridine, α-picoline, 2,6-lutidine, quinoline, propylenediamine, formamido, N-methylformamide, N,N-dimethylformamide, N,N-diethylformamide, acetoamido, N-methylacetoamido, N-methypropioneamido, N,N,N',N'-tetramethylurea and N-methylpyrrolidone; sulfur-containing compounds such as dimethyl sulfoxid and sulfolane; hydrocarbon kinds such as benzene, p-cymene, naphthalene, cyclohexylbenzene and cyclohexyene; and halogenated hydrocarbon kinds such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene (cis-), tetrachloroethylene, 2-chlorobutane, 1-chloro-2-methylpropane, 2-chloro-2-methylpropane, bromomethane, tribromomethane and 1-bromopropane. Further, two or more of the aforesaid liquids can be mixed to be used.

Further, when ejecting a liquid by using conductive paste containing abundantly substances having high conductivity (silver powder or the like) as liquid L, there is no restriction in particular for target substances to be dissolved or dispersed in the aforesaid liquid L, with the exception of coarse particles which generate clogging in a nozzle.

With respect to phosphors including PDP, CRT and FED, those which have been known in the past can be used without any restriction. For example, red phosphors which can be used include (Y, Gd) $BO_3$:Eu, $YO_3$:Eu, green phosphors which can be used include $Zn_2SiO_4$:Mn, $BaAl_{12}O_{19}$:Mn, (Ba, Sr, Mg) O.α–$Al_2O_3$:Mn, and blue phosphors which can be used include $BaMgAl_{14}O_{23}$:Eu, $BaMgAl_{10}O_{17}$:Eu.

For the purpose of causing the aforesaid target substances to adhere firmly to a recording medium, it is preferable to add various types of binders. Binders to be used include, for example, cellulose and its derivatives such as ethyl cellulose, methyl cellulose, nitro cellulose, cellulose acetate and hydroxyethyl cellulose; alkyd resin; (meta)acrylic resin and its metallic salt such as polymethacrylic acid, polymethyl methacrilate, 2-ethylhexylmethacrylate.methacrylic acid copolymer and lauryl methacrylate.2-hydroxyethyl methaacrylate copolymer; poly(meth)acrylamid resin such as poly N-isopropilacrylamide, poly N and N-dimethyl acryl amide; styrene-based resin such as polystyrene, acrylonitrile-styrene copolymer, styrene-maleic acid copolymer and styrene.isoprene copolymer; styrene.acrylic resin such as styrene.n-butylmethacrylate copolymer; saturated various polyester resins and unsaturated various polyester resins; polyolefin-based resin such as polypropylene; halogenated polymer such as polyvinyl chloride and poly vinyliden chloride; vinyl-based resin such as poly vinyl acetate, vinyl chloride vinyl acetate copolymer; polycarbonate resin; epoxy-based resin; polyurethane-based resin; polyacetal resin such as polyvinyl formal, polyvinyl butyral and polyvinyl acetal; polyethylene-based resin such as ethylene.vinyl acetate copolymer, ethylene-.ethyl acrylate copolymerization resin; amide resin such as benzoguanomine; urea resin; melamine resin; polyvinyl alcohol resin and its anion cation degeneration; polyvinyl pyrroridone and its copolymer; alkylene oxide homopolymer, copolymer and cross-linked polymer such as polyethylene oxide, carboxilated polyethylene oxide; polyalkylene glycol such as polyethylene glycol and polypropylene glycol; polyether polyol; SBR, NBR latex; dextrin; alginic acid sodium; natural or semi-synthetic resin such as gelatin and its derivative, casein, hibiscus, tragacanth gum, pullulan, gum arabic, Locast Bean Gum, Guar Gum, pectin, Carrageenin, glue, albumin, starches, cornstarch, devil's tongue, gloiopeltis, agar-agar and protein (soya beans); terpene resin; ketone resin; rosin and rosin ester; and polyvinyl methyl ether, polyethyleneimine, sulfonated polystyrene as well as sulfonated polyvinyl. The aforesaid resins may also be used on a blended basis in a range of compatibility, in addition to be used as a homopolymer.

When using a liquid ejection device 1 as a patterning device, a typical one is used for a display use. Concrete uses in this case include formation of a phosphor of plasma display, formation of a rib of plasma display, formation of an electrode of plasma display, formation of a phosphor of CRT, formation of a phosphor of FED (field emission type display), formation of a rib of FED, a color filter for a liquid crystal display (RGB colored layer, black matrix layers) and a spacer for liquid crystal display (a pattern corresponding to black matrix and dot patterns).

Meanwhile, a rib means a fence generally, and it is used for separating a plasma area for each color, in an example of plasma display. A use other than the foregoing includes a micro-lens, a use for a semi-conductor includes patterning coating for a magnetic material, a ferroelectric substance and a dielectric paste (wiring and antenna), a graphic use includes ordinary printing, printing on a specific medium (a film, a cloth, or a steel plate), printing on curved surfaces and printing for various types of printing plates, a use for processing includes coating employing the invention such as adhesive materials and sealing materials, and a biological and medical use includes an application for coating of medical supplies (those containing plural ingredients in minute quantities) and of samples for gene diagnoses.

Now, the principle of ejection of liquid L in liquid ejection head 2 of the invention will be explained as follows, referring to the present embodiment.

In the present embodiment, electrostatic voltage is impressed on electrode for charging 14 from electrostatic voltage power supply 16 so that an electric field may be generated between liquid L of liquid ejection opening 11 of nozzle 5 and an opposing surface that faces liquid ejection head 2 of opposing electrode 3. Further, drive voltage is impressed on piezoelectric element 22 from drive voltage power supply 23 to deform the piezoelectric element 22 so that a meniscus of liquid L may be formed on liquid ejection opening 11 of nozzle 5 with pressure generated in liquid L by the aforesaid deformation of the piezoelectric element 22.

Figure 4:
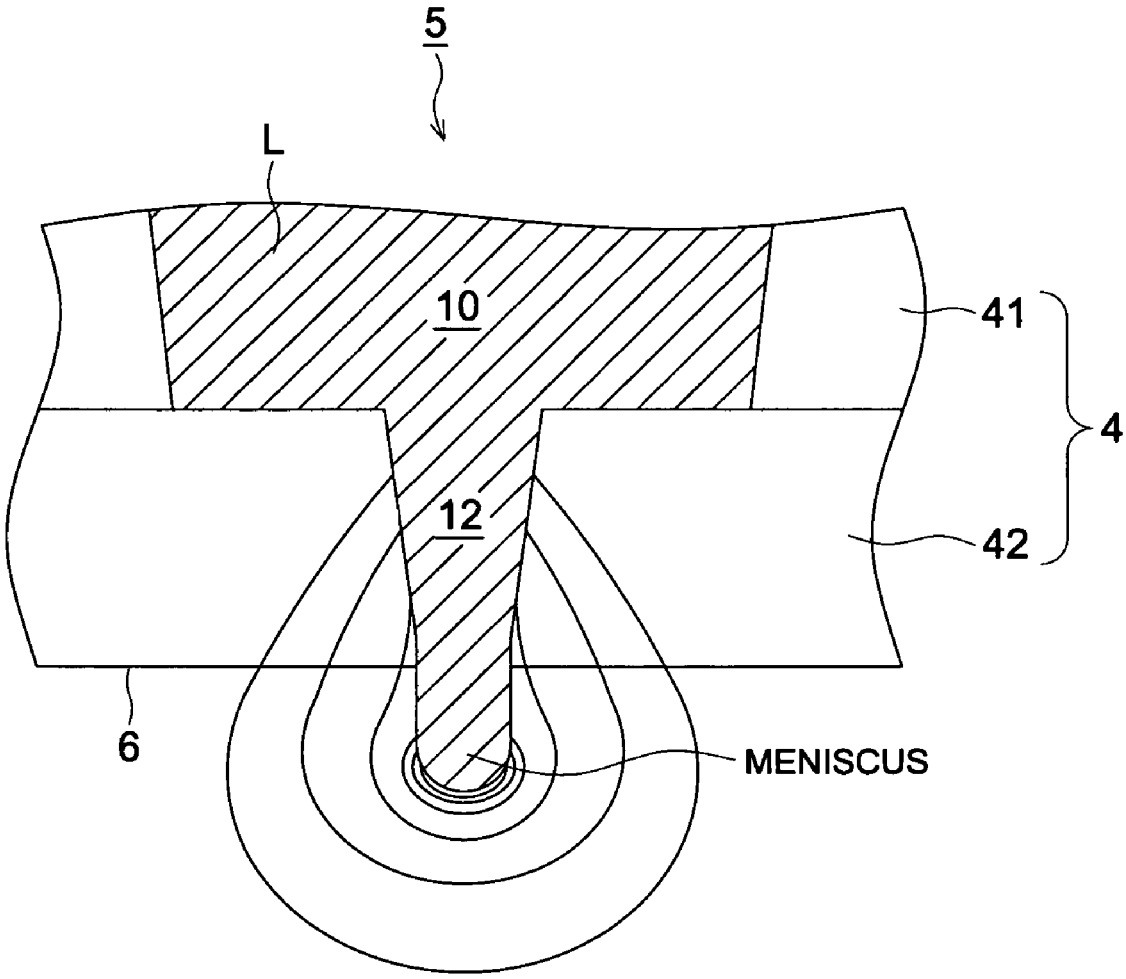
FIG. 4 is a schematic view showing a voltage distribution in the vicinity of a liquid ejection opening of a nozzle in a simulation.

When insulation property of nozzle plate 4 is enhanced as is in the present embodiment, equipotential lines stand side by side in the direction almost vertical to the liquid ejection surface 6 inside nozzle plate 4, as shown by equipotential lines by simulation in FIG. 4, thus, the strong electric field heading to liquid L of small diameter section 12 of nozzle 5 or a meniscus portion of the liquid L is generated.

In particular, an extremely strong electric field is concentrated on the tip portion of the meniscus, as is understood from equipotential lines which are crowded on the tip portion of the meniscus in FIG. 4. Therefore, the meniscus is torn off by electrostatic force of the electric field to be separated from liquid L in the nozzle to become droplet D. Further, the droplet D is accelerated by electrostatic force to be drawn toward base member K that is supported by opposing electrode 3, to impact. In that case, an angle of impacting on base member K is stabilized for accurate impacting because the droplet D is in a trend to impact at the closer position by an action of electrostatic force.

In the experiments made by the inventors of the invention under the following experiment conditions after arranging so that electric field intensity of an electric field between electrodes may become 1.5 kV/mm that is a practical value and by preparing various types of nozzle plates 4, droplets D were ejected from nozzle 5 in some cases, and they were not ejected in other cases.

[Experiment Conditions]

Distance from liquid ejection surface 6 of nozzle plate 4 to an opposing surface of opposing electrode 3: 1.0 mm Thickness of nozzle plate 4: 125 μm Nozzle diameter: 10 μm Electrostatic voltage: 1.5 kV Drive voltage: 20 V For each of all occasions when droplets D were ejected stably from nozzle 5 in this actual machine for testing, an electric field intensity at a tip portion of a meniscus was obtained. Actually, the electric field intensity was calculated by a simulation by current distribution analysis mode on "PHOTO-VOLT" (trade name, made by Photone, Inc.) that is an electric field simulation software, because it is difficult to measure directly the electric field intensity on a tip portion of a meniscus. As a result, the electric field intensity on a tip portion of a meniscus was $1.5\times10^7$V/m (15 kV/mm) or more for all occasions.

Figure 5:
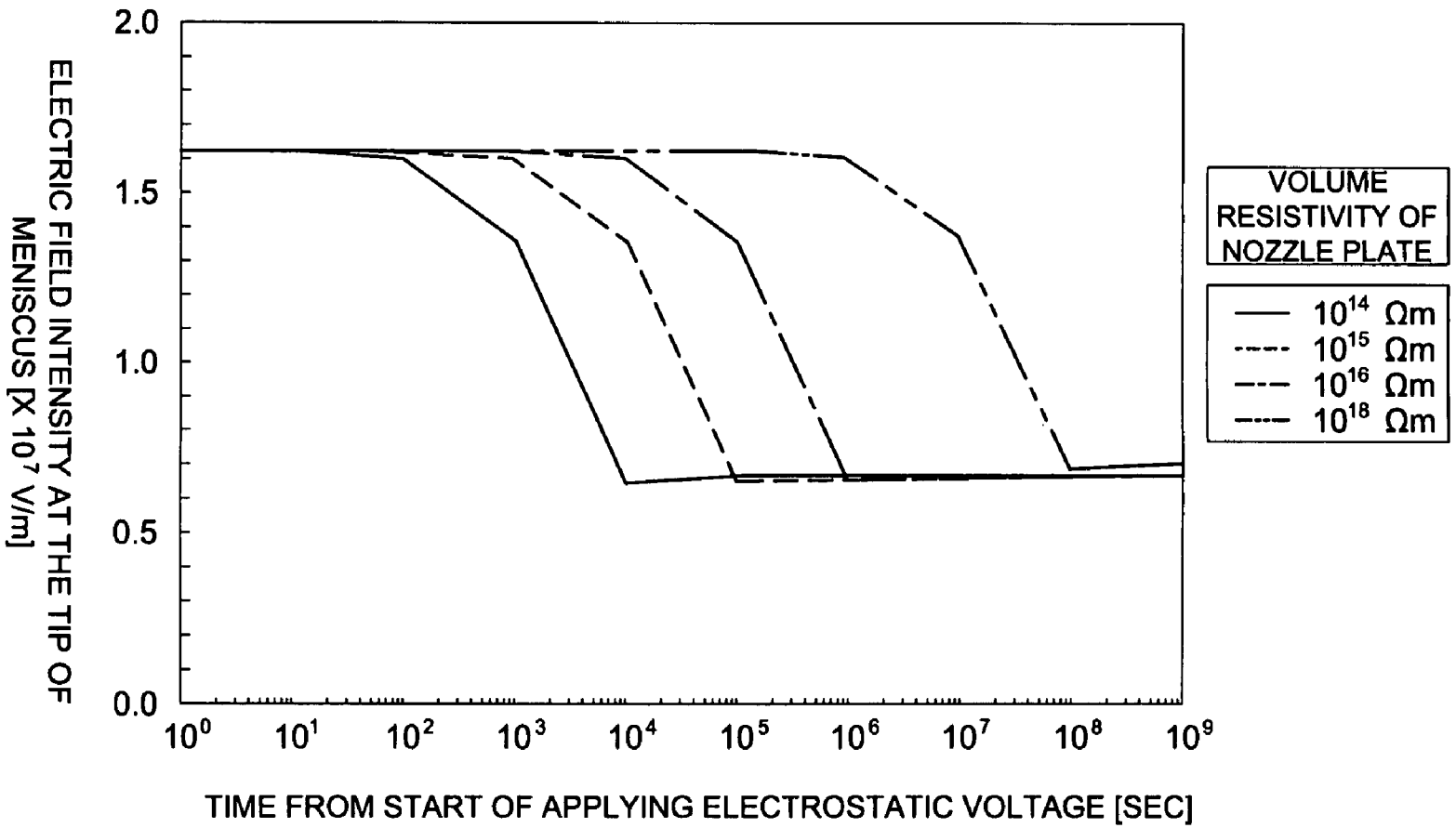
FIG. 5 is a diagram showing relationship between electric field intensity at a tip portion of a meniscus and a volume resistivity of a nozzle plate.

Further, as a result of operating an electric field intensity on a tip portion of a meniscus by inputting a parameter which is the same as that in the aforesaid experiment conditions into the same software, it was found that the electric field intensity depends strongly on volume resistivity of nozzle plate 4, as shown in FIG. 5.

FIG. 5 shows the results of calculation for how electric field intensity on a tip portion of a meniscus changed after impression of electrostatic voltage was started when volume resistivity of nozzle plate 4 was changed from $10^{14}$ Ωm to $10^{18}$ Ωm. In this calculation, it was necessary to establish volume resistivity of air, and it was made to be $10^{20}$ Ωm. FIG. 5 shows that electric field intensity on a tip portion of a meniscus is greatly lowered by ionic polarization of nozzle plate 4, after passage of 100 seconds from the start of impression of electrostatic voltage, when its volume resistivity is $10^{14}$ Ωm. A period of time from the start of impression of electrostatic voltage to the start of decline of electric field intensity on a tip portion of a meniscus is determined by a ratio of a volume resistivity of air to that of nozzle plate 4, and the greater the volume resistivity of nozzle plate 4 is, the later the electric field intensity on a tip portion of a meniscus starts declining. In other word, the greater the volume resistivity is, the longer a period of time for keeping necessary electric field intensity is, which is advantageous.

According to descriptions in documents and the like, a volume resistivity of a substance serving as an insulator or a dielectric body is $10^{10}$ Ωm or more in many cases, and a volume resistivity of borosilicate-glass (for example, PYREX (registered trade mark) glass) which is known as a typical insulator is $10^{14}$ Ωm.

However, in the case of an insulator with the volume resistivity of this kind, no droplet D is ejected. The presumed reason for this is that electric field intensity is lowered in the course of or before the evaluation for presence or absence of emission, and necessary electric field intensity cannot be obtained. Incidentally, the case of calculation where volume resistivity of air was assumed to be $10^{20}$ Ωm agreed with the results of experiments, when judging based on a period of time required for evaluation of emission and on a period of time of observation. After the electric field intensity on a tip portion of a meniscus has been lowered once, ionic polarization of the insulator used for nozzle plate 4 needs to be neutralized to return to the initial state.

As stated above, it is necessary that the electric field intensity on a tip portion of a meniscus is $1.5\times10^{7}$ V/m or more for ejecting droplet D from nozzle 5 stably, and FIG. 5 shows that a volume resistivity of nozzle plate 4 needs practically to be $10^{15}$ Ωm or more that can keep electric field intensity of a tip portion of a meniscus for at least 1000 seconds, which agreed with the experiments.

The reason why relationship between volume resistivity of nozzle plate 4 and electric field intensity on a tip portion of a meniscus becomes a distinctive one is thought to be a background wherein, if the volume resistivity of nozzle plate 4 is low, equipotential lines do not stand side by side in the direction almost vertical to liquid ejection surface 6 as shown in FIG. 4 in the nozzle plate, even if electrostatic voltage is impressed, and electric fields are not concentrated sufficiently to liquid L in the nozzle and to the meniscus of liquid L.

Even in the case of nozzle plate 4 whose volume resistivity is less than $10^{15}$ Ωm, there is a possibility that droplet D is ejected through nozzle 5 theoretically, if electrostatic voltage is made to be extremely high. However, the nozzle plate of this kind is not used in the invention, because there is a fear that base member K will be damaged by an occurrence of sparks between electrodes.

A distinctive dependence relation for electric field intensity on a tip portion of a meniscus shown in FIG. 5 on a volume resistivity of nozzle plate 4 is obtained equally even in the case of carrying out simulations by changing a nozzle diameter variously, and it is understood that the electric field intensity on a tip portion of a meniscus becomes to be $1.5\times10^{7}$ V/m or more when the volume resistivity is $10^{15}$ Ωm or more, in all occasions of the simulations. Further, a thickness of nozzle plate 4 in the aforesaid experiment conditions is equal to the sum of a length of small diameter section 12 and a length of large diameter section 10 of nozzle 5.

There is further an occasion where droplet D is not ejected through nozzle 5 even when nozzle plate 4 is made by using an insulator whose volume resistivity is $10^{15}$ Ωm or more. As is shown in Unexamined Japanese Patent Application Publication No. 2006-181926, it is preferable that an absorptivity of nozzle plate 4 for a liquid is 0.3% or less in the experiment using a liquid containing a conductive solvent such as water as liquid L, though kinds of the liquid have an influence.

The reason for the foregoing is as follows; when the conductive solvent is absorbed by nozzle plate 4 from liquid L, molecules such as water molecules representing a conductive liquid become to exist in nozzle plate 4, resulting in higher electric conductivity of nozzle plate 4, and especially in a lower value of effective volume resistivity on a local portion coming in contact with liquid L, thus, electric field intensity on a tip portion of a meniscus is weakened in accordance with a relationship shown in FIG. 5, which makes it impossible to obtain concentration of an electric field that is needed for ejection of liquid L.

Further, when a liquid where chargeable particles are dispersed in an insulating solvent is used as liquid L, it is known that nozzle plate 4 ejects liquid L independently of absorptivity for the liquid, if volume resistivity is $10^{15}$ Ωm or more. The reason for this is considered as follows; namely, even when an insulating solvent is absorbed into nozzle plate 4, electric conductivity of nozzle plate 4 is not changed greatly because the electric conductivity of the insulating solvent is low, and thereby, effective volume resistivity is not lowered.

Incidentally, particles which are dispersed in the aforesaid insulating solvent and can be charged electrically are not absorbed in nozzle plate 4 even when the particles are metallic particles having an extremely great electric conductivity, for example, and therefore, they do not enhance electric conductivity of nozzle plate 4. Meanwhile, the aforesaid insulating solvent means a solvent that is not ejected by electrostatic attraction force, as a simple substance, and there are given concretely, for example, xylene, toluene and tetradecane. Further, the conductive solvent means a solvent whose electric conductivity is $10^{-10}$ S/cm or more.

Figure 6:
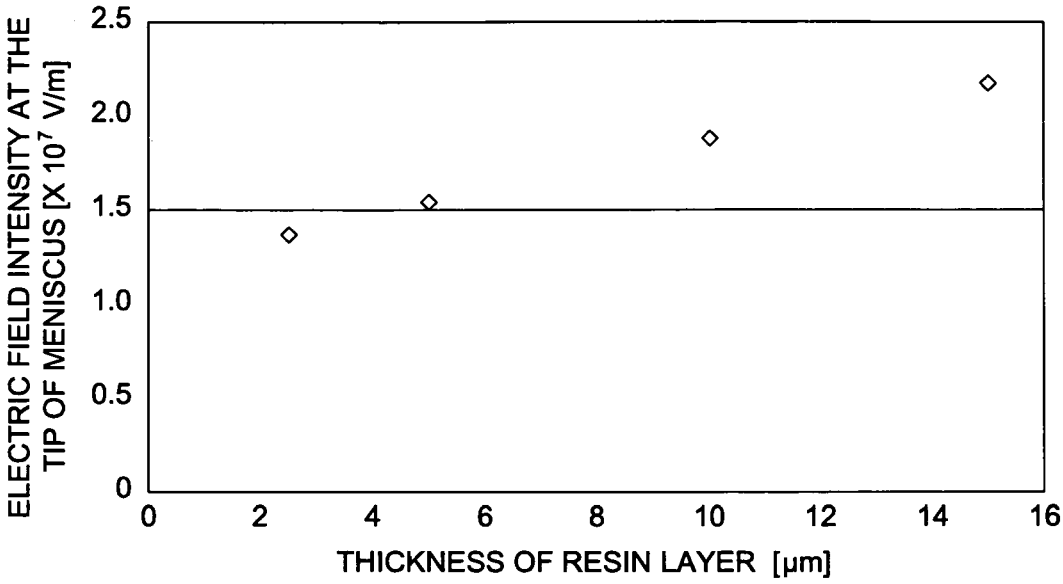
FIG. 6 is a diagram showing relationship between electric field intensity at a tip portion of a meniscus and a thickness of a resin layer of the nozzle plate.
Figure 7:
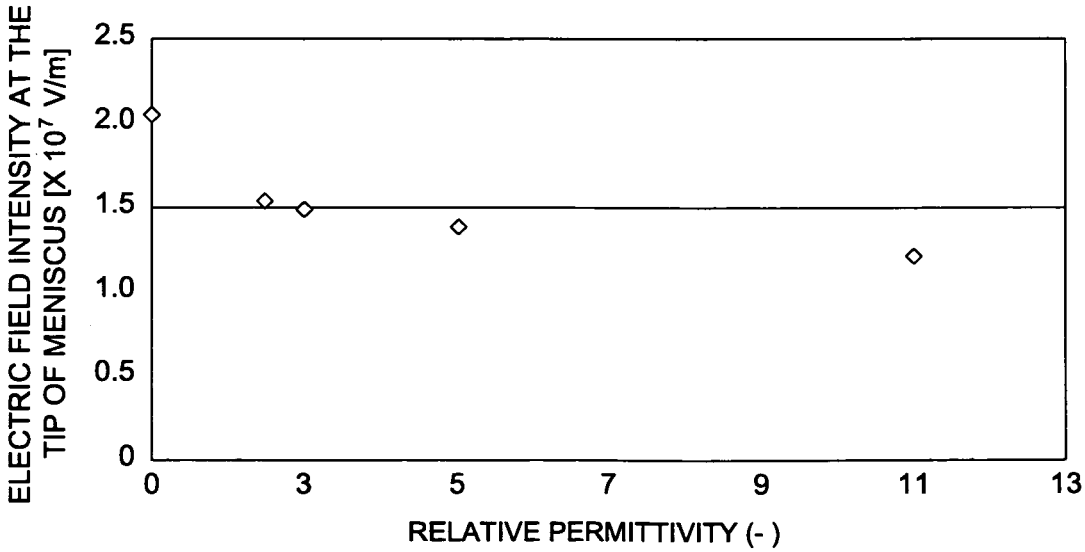
FIG. 7 is a diagram showing relationship between electric field intensity at a tip portion of a meniscus and a relative permittivity of a resin layer of the nozzle plate.

Further, each of FIG. 6 and FIG. 7 shows electric field intensity on a tip portion of a meniscus in the case where a thickness and a relative permittivity of resin layer 42 of nozzle plate 4 were changed under the nozzle diameter of 5 μm in the aforesaid simulation. From the results thereof, it is understood that the electric field intensity on a tip portion of a meniscus depends on a thickness and relative permittivity of the resin layer 42, and that it is preferable to make a thickness of the resin layer 42 to be 5 μm or more and to make relative permittivity to be 3 or less, for the purpose to make electric field intensity on a tip portion of a meniscus to be about $1.5\times10^{7}$ V/m or more.

The reasons why electric field intensity on a tip portion of a meniscus depends on a thickness of the resin layer 42 of nozzle plate 4 and why the electric field intensity is increased when the thickness of the resin layer 42 is increased are considered to be a phenomenon wherein, when a thickness of the resin layer 42 of the nozzle plate 4 becomes thicker, the electric field tends to concentrate easily to a tip portion of a meniscus because insulation properties of nozzle plate 4 are increased.

Figure 8:
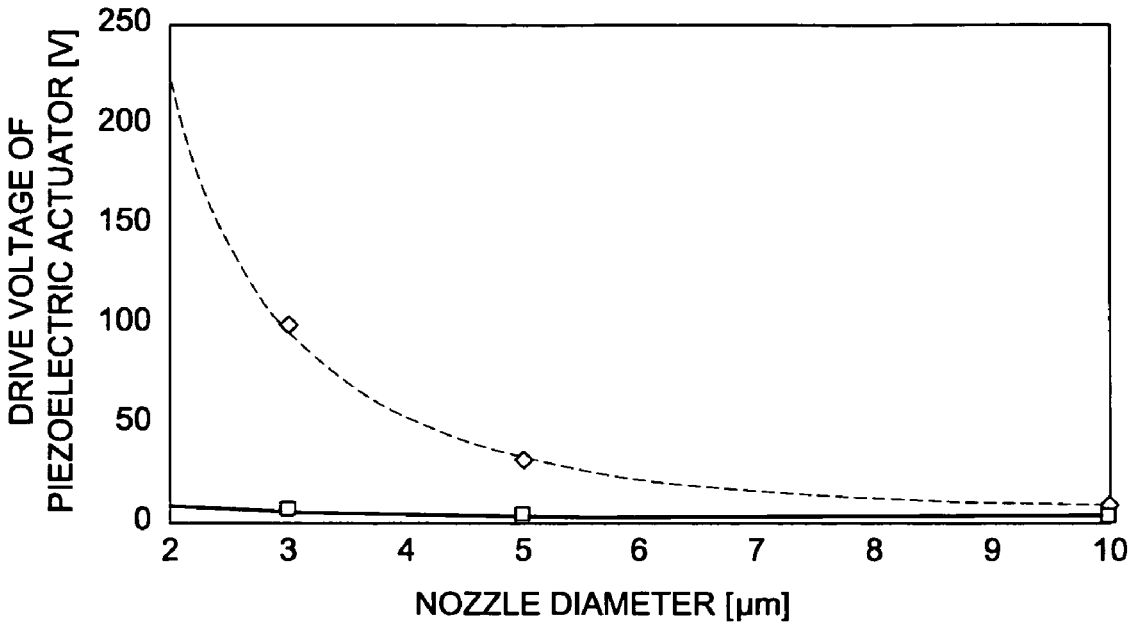
FIG. 8 is a diagram showing relationship between drive voltage and a nozzle diameter.

Further, solid lines in FIG. 8 show relationship between drive voltage impressed on piezoelectric element actuator and a nozzle diameter in the occasion where a thickness of resin layer 42 of nozzle plate 4 is made to be 5 μm and relative permittivity is made to be 2.5. Further, broken lines in FIG. 8 show relationship between drive voltage in a piezoelectric ejection method and a nozzle diameter, as a comparative example.

"The piezoelectric ejection method" in this case means a method in which a part of a liquid is separated by causing pressure from a liquid to become a droplet, and the droplet is caused to fly. Incidentally, the comparison is made under the condition that the nozzle diameters are 3 μm, 5 μm and 10 μm.

From the results of the foregoing, it is understood that the drive voltage can be kept almost constant independently of a nozzle diameter, when a thickness of resin layer 42 is made to be 5 μm, and relative permittivity is made to be 2.5.

Next, a method of forming nozzle 5 of liquid ejection head 2 in the present embodiment will be explained.

Figure 9A:
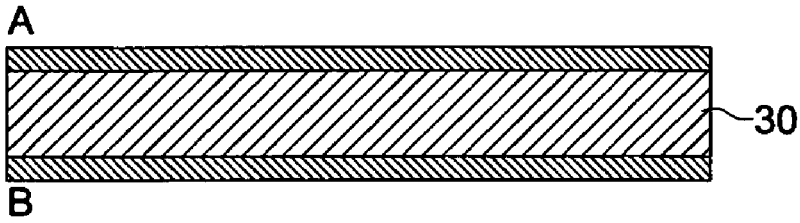

First, as shown in FIG. 9*a*, silicon base plate 30 wherein 2 μm-thick thermal-oxidative film is formed on each of upper surface (surface A) and lower surface (surface B) of 200 μm-thick two-sided mirror wafer, is prepared.

Figure 9B:
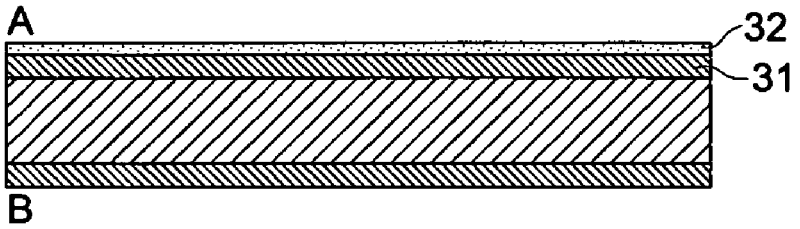

Next, as shown in FIG. 9*b*, an oxidized film on surface A of silicon base plate 30 is removed, thermosetting fluorine polymer layer 31 is formed by a spin-coating method and SiH film 32 is formed on upper surface of the thermosetting fluorine polymer layer 31.

Figure 9C:
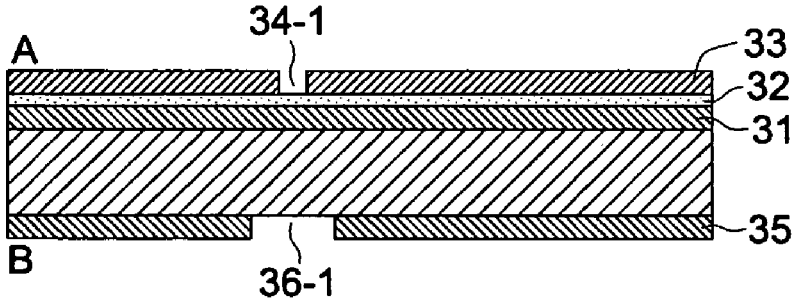

Next, oxidized film 33 is formed on the SiH film 32, and opening section 34-1 is formed on oxidized film 33 as shown in FIG. 9*c* through lithography technology. Further, opening section 36-1 is formed on oxidized film 35 on surface B.

Figure 9D:
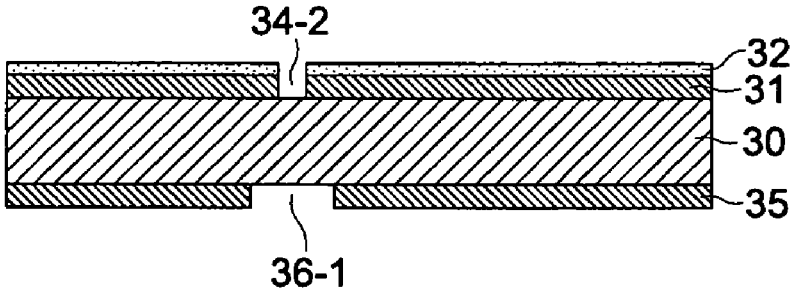

Next, on surface A, as shown in FIG. 9*d*, opening sections 34-2 are formed on SiH film 32 and on thermosetting fluorine polymer layer 31 by conducting etching on SiH film 32 and on thermosetting fluorine polymer layer 31 until they arrive at silicon base plate 30 with oxidized film 33 serving as a mask, and after that, oxidized film 33 is removed.

Figure 10A:
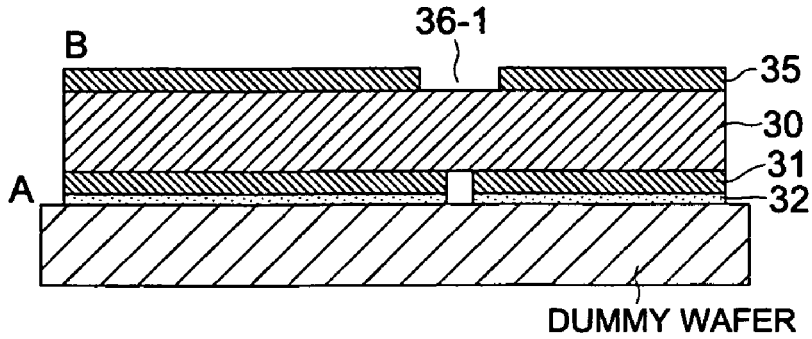

Next, as shown in FIG. 10*a*, surface A of silicon base plate 30 is fixed on a dummy wafer composed of silicon by using cool grease so that surface B of silicon base plate 30 may become the upper side.

Figure 10B:
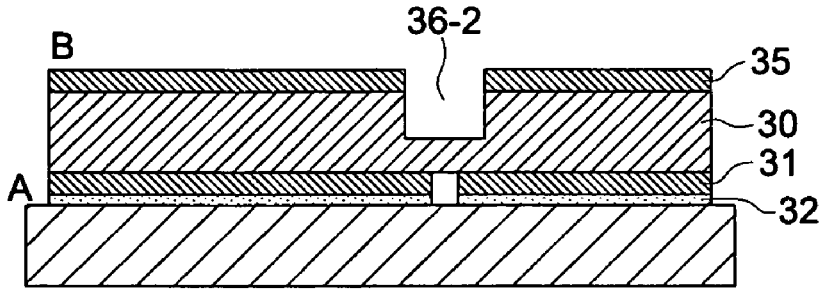

Next, as shown in FIG. 10*b*, silicon base plate 30 is etched selectively through opening section 36-1 by ICP (Inductively Coupled Plasma) method with oxidized film 35 serving as a mask. Then, the silicon base plate 30 is dug out to be passed through finally to form opening section 36-2.

Figure 10C:
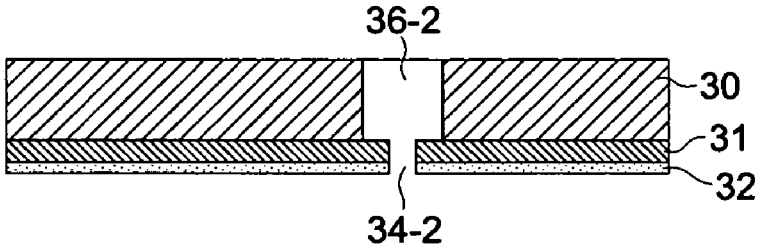

Next, as shown in FIG. 10*c*, the oxidized film 35 is removed through reactive ion etching, then, after surface treatment is conducted as occasion demands, the remainder is used as nozzle plate 4. The aforesaid opening section 36-2 corresponds to large diameter section 10 of nozzle 5, while, opening section 34-2 corresponds to small diameter section 12 of nozzle 5.

Incidentally, it is also possible to dig down silicon base plate 30 to the prescribed depth through opening section 36-1 on surface B to form 36-2, and then to conduct etching selectively until the moment to arrive at opening 36-2 through opening section 34-2 from surface A to pass through the silicon base plate 30.

It is further possible to form thermosetting fluorine polymer layer 31 of surface A and to form opening section 34-2 on SiH film 32, after forming opening section 36-2 on surface B.

Liquid ejection head 2 of the present embodiment is formed by forming electrode for charging 14 on nozzle plate 4 that is made in the aforesaid way, and by cementing body layer 19 formed separately by an anode cementing method through the electrode for charging 14.

In this case, the nozzle plate 4 with the electrode for charging 14 is caused to come in contact with the body layer 19.

Next, under this condition, they are heated up to 350° C.-450° C., and voltage immediately before the moment when a leak current flows between the nozzle plate 4 and the body layer 19 is impressed between the nozzle plate 4 and the body layer 19 to join them. After the nozzle plate 4 and the body layer 19 are joined together, a liquid channel connecting to nozzle 5 is formed.

After the liquid channel is formed, piezoelectric element 22 is provided, and necessary wiring, connection and packaging are carried out.

Next, actions of liquid ejection head 2 and of liquid ejection device 1 will be explained as follows.

FIG. 11 is a diagram illustrating drive control for a liquid ejection head in a liquid ejection device of the present embodiment. In the present embodiment, operation control device 24 of the liquid ejection device 1 causes constant electro static voltage $V_c$ to be impressed on electrode for charging 14 from charging voltage power supply 16. Owing to this, liquid L in its nozzle 5 is charged electrically, and an electric field is generated between the liquid L and opposing electrode 3.

Further, the operation control device 24 causes pulse-shaped drive voltage $V_D$ to be impressed on piezoelectric element 22 from drive voltage power supply 23 corresponding to nozzle 5 for each nozzle 5 to be caused to eject droplet D. If the drive voltage $V_D$ of this kind is impressed, piezoelectric element 22 is deformed to enhance pressure of liquid L in the nozzle, thus, a meniscus starts protruding from the state of A in the diagram in nozzle 5, to become the state where the meniscus has protruded greatly as shown by B.

Then, as stated above, advanced concentration of an electric field is caused on a tip portion of a meniscus to make the electric field intensity to be extremely strong, whereby, strong electrostatic attraction force is added from the electric field formed by the aforesaid electrostatic voltage $V_C$ for the meniscus. Thus, the meniscus is torn off by suction caused by this strong electrostatic attraction force and by pressure caused by piezoelectric element 22, as in C in the diagram, to form droplet D. The droplet D is accelerated by the electric field and is attracted in the direction toward an opposing electrode to impact on base member K supported by opposing electrode 3.

In that case, though air resistance or the like is applied on the droplet D, an action of the electrostatic force causes the droplet D to try to impact the closer position as stated above, therefore, the direction of impacting for base member K is not deflected, and impacting on base member K is accurate.

Figure 12A:
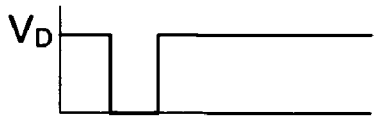
Figure 12B:
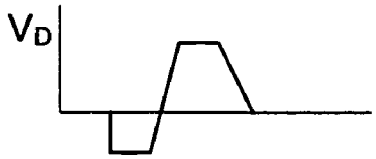
Figure 12C:
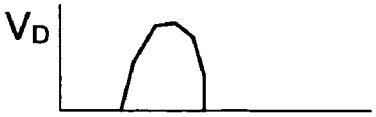

Incidentally, though it is possible to impress a pulse-shaped voltage as in the present embodiment as drive voltage $V_D$ to be impressed on piezoelectric element 22, it is also possible to arrange so that, for example, a so-called triangle-shaped voltage that gradually falls after gradually rises is impressed, a trapezoid-shaped voltage that gradually rises, then, keeps a constant value temporarily, and gradually falls is impressed or a sine-wave voltage is impressed. Further, as shown in FIG. 12*a*, it is also possible to make up the system wherein voltage $V_D$ is impressed constantly on piezoelectric element 22, then, the voltage is cut temporarily, and the voltage $V_D$ is impressed again, and droplet D is ejected at the start of impressing the voltage. It is also possible to construct an arrangement to impress various drive voltages $V_D$ shown in FIG. 12*b* and FIG. 12*c*.

According to the invention relating to the present embodiment, it is possible to lower drive voltage that is needed to eject liquid L, because it is possible to concentrate an electric field on a tip portion of a nozzle, and thereby, to generate strong electrostatic attraction force stably for a long time, as stated above. It is further possible to lower a value of voltage of electrostatic voltage to be impressed by an electrostatic voltage generating device, because a meniscus protrudes greatly under electrostatic voltage at low voltage.

Further, a droplet ejected from nozzle 5 is made by an effect of electrostatic attraction force caused by the electric field to impact at the closer portion on base member K, thus, it is possible to stabilize an angle for base member K in the case of impacting, and therefore, to impact a droplet accurately at a prescribed impacting position.

In addition, since resin layer 42 on which nozzle 5 is formed is made of thermosetting polymer whose water absorption percentage is 0.3% or less, strong electrostatic attraction force can be generated and maintained stably for a long time without being affected by solid state properties of a liquid, which makes it possible to lower drive voltage that is needed to eject the liquid.

Further, by making a thickness of the resin layer 42 to be 5 μm or more, electric field concentration to the circumference of a nozzle is enhanced, and stronger electrostatic attraction force can be generated, and drive voltage that is needed for forming a meniscus and for forming a droplet can further be lowered.

An actual situation that a glass transition point of thermosetting fluorine polymer forming resin layer 42 is 350° C. or higher makes it possible to conduct anodic bonding that is accompanied by a superheated process that can decrease clogging greatly for a minute nozzle in the case of assembling bonding.

Further, by making a thickness of intermediate layer 62 to be 1 μm or more, it is possible to enhance stiffness of a nozzle, to improve ejection characteristics and to enhance stiffness of a basic substrate for liquid-repelling layer 61, whereby, abrasion resistance in the case of cleaning operations can be improved.

Though the thermosetting fluorine polymer is used to form resin layer of nozzle plate 4 in the present embodiment, it is also possible to use a photosensitive fluorine polymer having values of solid state properties which are the same as those in the present embodiment, including volume resistivity $10^{15}$ Ωm or more, relative permittivity 3 or less, glass transition point 350° C. or more and liquid absorptivity 0.3% or less, as a material forming resin layer 42. In this case, it is possible to conduct masking on a resin layer made of photosensitive fluorine polymer through lithography technology, and to conduct developing after exposing to specific light such as ultraviolet radiation, to form nozzle 5 of liquid ejection head 2.

Figure 3:
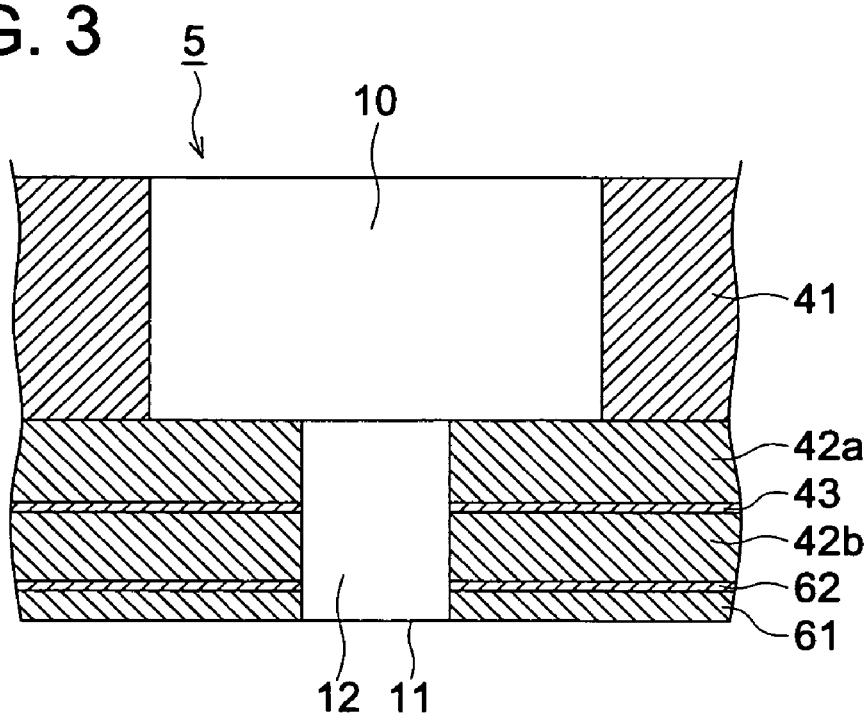
FIG. 3 is an enlarged sectional view showing a variety of structures of a nozzle and a nozzle plate.

Further, as a structure of resin layer 42 of nozzle plate 4, it is also possible to employ a structure wherein two or more layers of resin layers 42*a* and 42*b* are laminated through intermediate layers 43 that is made by Si or SiH to interpose between the resin layers, as shown in FIG. 3. Owing to the structure of this kind, increase of the thickness of total resin layers 42 can be performed easily.

As a result, electric field concentration on the circumference of the nozzle is further enhanced and stronger electrostatic attraction force is generated, thus, drive voltage necessary for forming a meniscus and for forming a droplet can further be lowered.

What is claimed is:

1. A liquid ejection head comprising:

a nozzle plate which comprises a nozzle having a liquid supply inlet through which a liquid is supplied, a liquid ejection opening through which the liquid supplied from the liquid supply inlet is ejected, and a liquid supply path through which a liquid is supplied from the liquid supply inlet to the liquid ejection opening;

a cavity which is communicated with the liquid supply inlet, and stores the liquid to be ejected from the liquid ejection opening;

a pressure generating device which generates a pressure to the liquid in the cavity by changing a volume of the cavity; and an electrostatic voltage generating device which applies electrostatic voltage to generate an electrostatic attraction force between a base member on an opposing electrode and the liquid in the nozzle and the cavity, wherein a liquid supply inlet side of the nozzle plate is formed of a silicon layer, and a liquid ejection opening side of the nozzle plate is formed of at least a resin layer comprising thermosetting or photosensitive fluorine polymer having a volume resistivity of $10^{15}$ Ωm or more and relative permittivity of 3 or less, and wherein a nozzle diameter on the liquid supply inlet side of the nozzle is greater than a nozzle diameter on the liquid ejection opening side of the nozzle.

2. The liquid ejection head described in claim 1, wherein the resin layer has absorptivity of 0.3% or less of the liquid.

3. The liquid ejection head described in claim 2, wherein the resin layer is composed of two or more layers sandwiching an intermediate layer made of Si or SiH.

4. The liquid ejection head described in claim 1, wherein a thickness of the resin layer is 5 μm or more.

5. The liquid ejection head described in claim 1, wherein a glass transition temperature of thermosetting or photosensitive fluorine polymer which forms the resin layer is 350° C. or more.

6. The liquid ejection head described in claim 1, wherein a liquid-repellent layer is formed on a surface of the resin layer of the nozzle plate on the liquid ejection opening side through an intermediate layer made of $SiO_2$.

7. The liquid ejection head described in claim 6, wherein a thickness of the intermediate layer made of $SiO_2$ is 1 μm or more.

8. A liquid ejection device comprising:

the liquid ejection head described in claim 1; and an opposing electrode arranged to oppose the liquid ejection head, wherein the liquid is ejected with the electrostatic attraction force generated between the liquid ejection head and the opposing electrode, and with the pressure generated in the nozzle.

* * * * *